US007827759B1

(12) United States Patent
Barnes

(10) Patent No.: US 7,827,759 B1
(45) Date of Patent: Nov. 9, 2010

(54) METHOD OF REPAIRING CONCRETE FLOORS AND SYSTEM FOR SAME

(76) Inventor: Audrey Barnes, 3422 Forest Vista Dr., Dacula, GA (US) 30019

( * ) Notice: Subject to any disclaimer, the term of this patent is extended or adjusted under 35 U.S.C. 154(b) by 756 days.

(21) Appl. No.: 11/649,554

(22) Filed: Jan. 4, 2007

(51) Int. Cl.
*E04B 1/00* (2006.01)

(52) U.S. Cl. ..... 52/742.14; 52/742.1; 52/514.5; 52/220.8; 52/232

(58) Field of Classification Search ..... 52/514, 52/514.5, 741.1, 742.1, 741.4
See application file for complete search history.

(56) References Cited

U.S. PATENT DOCUMENTS 1,809,613 A 6/1931 Walker
2,010,569 A 8/1935 Sitzler
2,190,532 A * 2/1940 Lukomski ..... 210/164
3,289,374 A * 12/1966 Metz ..... 52/514
3,298,653 A * 1/1967 Ohmholt ..... 248/508
3,344,011 A * 9/1967 Goozner ..... 428/67
3,543,459 A * 12/1970 Mills ..... 52/169.11
3,575,372 A * 4/1971 Emberson ..... 248/501
3,603,048 A 9/1971 Hadfield et al.
3,736,713 A * 6/1973 Flachbarth et al. ..... 52/220.1
3,896,511 A * 7/1975 Cuschera ..... 4/288
3,911,635 A 10/1975 Traupe
4,146,939 A * 4/1979 Izzi ..... 4/286
4,258,606 A * 3/1981 Wilson ..... 411/406
4,270,318 A 6/1981 Carroll et al.
4,432,465 A * 2/1984 Wuertz ..... 220/235
4,620,330 A * 11/1986 Izzi, Sr. ..... 4/288
4,620,407 A * 11/1986 Schmid ..... 52/745.09
4,693,652 A * 9/1987 Sweeney ..... 411/23
4,780,571 A * 10/1988 Huang ..... 174/484
4,879,771 A * 11/1989 Piskula ..... 4/256.1
5,035,097 A * 7/1991 Cornwall ..... 52/220.8
5,072,557 A * 12/1991 Naka et al. ..... 52/126.6
5,121,579 A * 6/1992 Hamar et al. ..... 52/582.1
5,456,050 A * 10/1995 Ward ..... 52/220.8
5,479,745 A * 1/1996 Kawai et al. ..... 52/126.6
5,528,867 A * 6/1996 Thompson ..... 52/125.5
5,878,448 A * 3/1999 Molter ..... 4/613
5,957,619 A * 9/1999 Kinoshita et al. ..... 404/31
6,189,573 B1 * 2/2001 Ziehm ..... 138/89
6,350,373 B1 * 2/2002 Sondrup ..... 210/164
6,439,817 B1 * 8/2002 Reed ..... 411/110
6,443,495 B1 * 9/2002 Harmeling ..... 285/56
6,862,863 B2 * 3/2005 McCorkle et al. ..... 52/787.1
6,905,650 B2 * 6/2005 McIntosh et al. ..... 264/554
7,210,557 B2 * 5/2007 Phillips et al. ..... 181/207
7,222,460 B2 * 5/2007 Francies et al. ..... 52/3
7,225,824 B2 * 6/2007 West et al. ..... 137/15.01
7,278,450 B1 * 10/2007 Condon ..... 138/89
7,287,738 B2 * 10/2007 Pitlor ..... 248/544

(Continued)

*Primary Examiner*—Richard E Chilcot, Jr.
*Assistant Examiner*—Alp Akbasli
(74) *Attorney, Agent, or Firm*—Baker Donelson

(57) ABSTRACT

A floor plug (10) is disclosed having a top plate (11) and a neck (12), the neck defining a top plate lip (14). To repair a bore hole (20) in a concrete floor (21) an adhesive (19) is applied to the underside of the lip (14) and the neck (12) is positioned within the bore hole (20). Once the adhesive has cured a viscous smoothing compound or concrete floor leveler is poured over the floor plug (21) and surrounding concrete floor area. If necessary, the concrete floor leveler material is smoothed to provide a generally smooth or level surface.

21 Claims, 2 Drawing Sheets

U.S. PATENT DOCUMENTS

| | | | | |
|---|---|---|---|---|
| 7,441,375 | B2 * | 10/2008 | Lang | 52/125.5 |
| 7,665,272 | B2 * | 2/2010 | Reen | 52/742.14 |
| 2004/0113390 | A1 * | 6/2004 | Broussard, III | 280/415.1 |
| 2005/0120660 | A1 * | 6/2005 | Kim et al. | 52/514 |
| 2005/0155305 | A1 * | 7/2005 | Cosenza et al. | 52/317 |
| 2005/0193660 | A1 * | 9/2005 | Mead | 52/263 |
| 2006/0010817 | A1 * | 1/2006 | Shull | 52/514 |
| 2007/0137135 | A1 * | 6/2007 | Shymkowich | 52/698 |

* cited by examiner

METHOD OF REPAIRING CONCRETE FLOORS AND SYSTEM FOR SAME

TECHNICAL FIELD

This invention relates to a method of repairing a hole in a concrete floor and a system for repairing such.

BACKGROUND OF THE INVENTION

Concrete floors are oftentimes drilled or cored to form a bore hole through which electrical wiring or plumbing pipes are passed. Oftentimes, the reconfiguration of an office space requires that these wires or pipes be relocated, leaving a hole in the floor. As such, these holes must be repaired or filled so that an overlying carpet or tile may be placed over the hole.

One method of repairing a bore hole has been to place a filling material into the hole and then applying a viscous smoothing compound over the hole. The smoothing compound then hardens to provide a finished surface.

It is seen that a need exists for a method of repairing a hole within a concrete floor that provides a supporting surface. It is to the provision of such therefore that the present invention is primarily directed.

SUMMARY OF THE PRESENT INVENTION

In a preferred form of the invention, a method of repairing a hole within a concrete floor comprises the steps of providing a plug having a top plate of a size larger than the hole in the concrete floor and a neck of a size smaller than the hole in the concrete floor, positioning the neck of the plug within the hole of the concrete floor and abutting the top plate against the concrete floor surrounding the hole, overlaying the plug top plate and a portion of the concrete floor surrounding the hole with a viscous leveler, smoothing the viscous leveler, and allowing the viscous leveler to cure to a hardened state.

In another preferred form of the invention, a concrete floor repairing system for repairing a hole in concrete comprises a plug having a top plate of a size large than the hole in the concrete and a neck extending from the top plate. The neck has a size smaller than the hole in the concrete. The system also includes a concrete leveling compound adapted to overlay the plug and a portion of the concrete floor in a viscous form and then be cured to a hardened state. With this construction, the plug is placed so that the neck is positioned within the concrete hole and a portion of the top plate overlays the surrounding concrete, and the concrete leveling compound covers the plug to provide a generally even or smooth surface.

DETAILED DESCRIPTION

Figure 1:
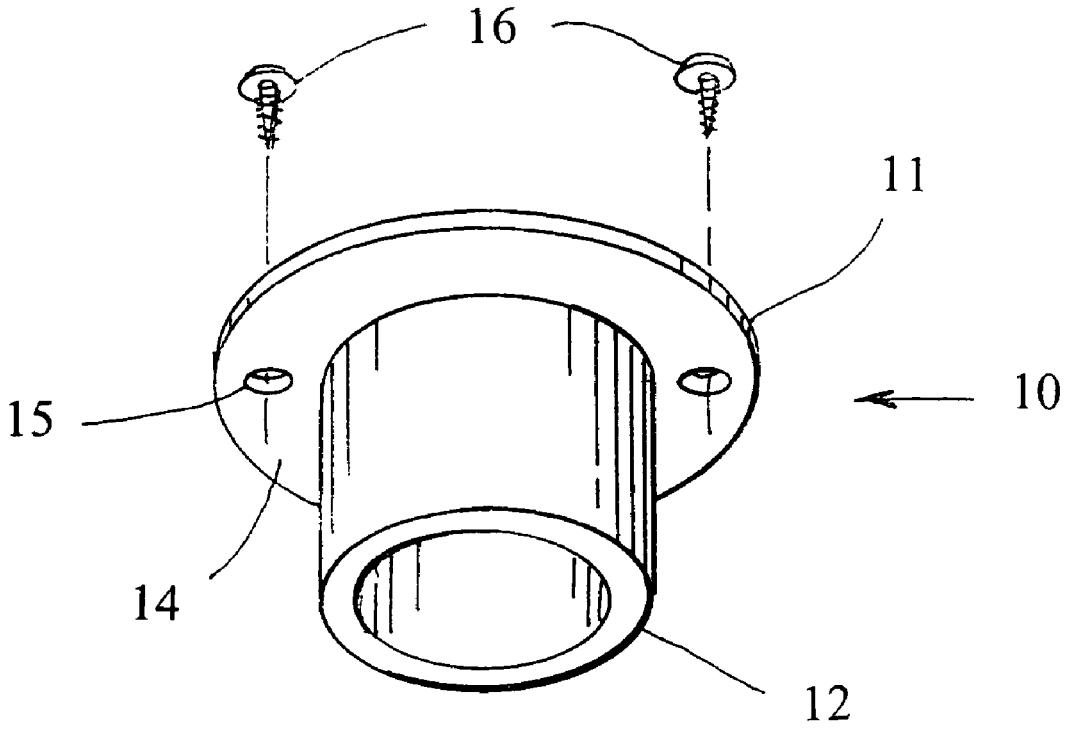
FIG. 1 is a perspective view of a floor plug that embodies principles of the invention in a preferred form.

With reference next to the drawings, there is shown a floor plug 10 in a preferred form of the invention. The floor plug 10 includes a round, generally planar top plate 11 and a cylindrical neck 12 depending from the top plate 11. The diameter of the neck 12 is smaller than that of the top plate 11 so that the a portion of the top plate 11 forms a lip portion or lip 14 extending beyond the neck 12. The top plate 11 may include one or more mounting holes 15 through which mounting screws 16 may pass. Preferably, the floor plug is made of a galvanized metal, however, the plug may also be made of other suitable materials including, but not limited to, other metal, polymer, resin or plastic materials.

In use, an adhesive 19 is applied to the underside of the top plate lip 14 and the floor plug 10 is positioned so that its neck 12 fits within the bore hole 20 within a concrete floor 21. The adhesive 19 may also have a fire barrier property, such as Fire Barrier Sealant IC 15WB, made by 3M Company of St. Paul, Minn. The size of the floor plug should be chosen so that the spacing between the neck and the bore hole is minimal, thereby providing the best fit therebetween. The floor plug lip 14 overhangs or is positioned over the surrounding concrete floor 21 defining the bore hole to prevent the floor plug from passing completely through the bore hole 20. Mounting screws 16 may be passed through mounting holes 15 and into pre-drilled holes within the underlying concrete floor to help stabilize the floor plug. It should be understood that the use of the adhesive and/or the mounting screws is optional.

Once the adhesive has cured a viscous smoothing compound or concrete floor leveler 22, such as DAP Bondex Concrete Floor Leveler, made by Dap Brands Company of Baltimore, Md., is poured over the floor plug 10 and surrounding concrete floor area 21. If necessary, the concrete floor leveler material is smoothed to provide a generally smooth or level surface, the term generally being utilized since it is obvious that the floor cannot be absolutely smooth or level due to the minimal presence of the top plate and/or variations in the materials.

Once the concrete floor leveler has cured or dried to a hardened state, a finished flooring material, such as carpet or tile, may be overlaid upon the finished concrete floor.

Figure 5:
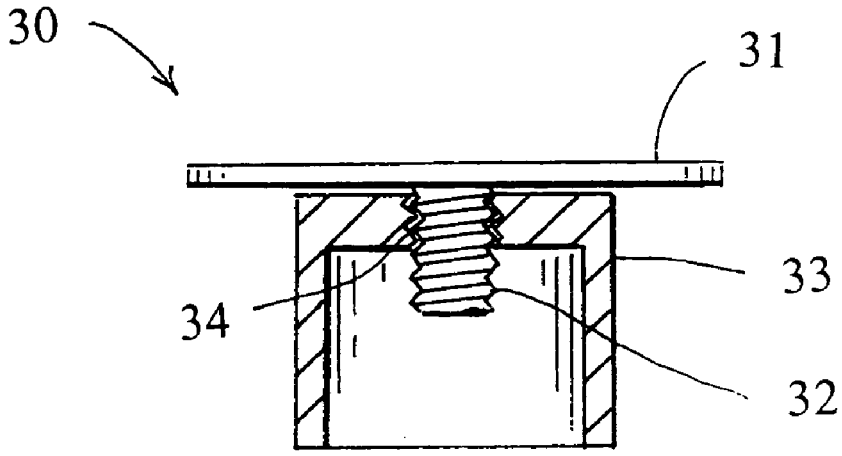
FIG. 5 is a side view, shown in partial cross-section, of a floor plug in another preferred form of the invention.
Figure 2:
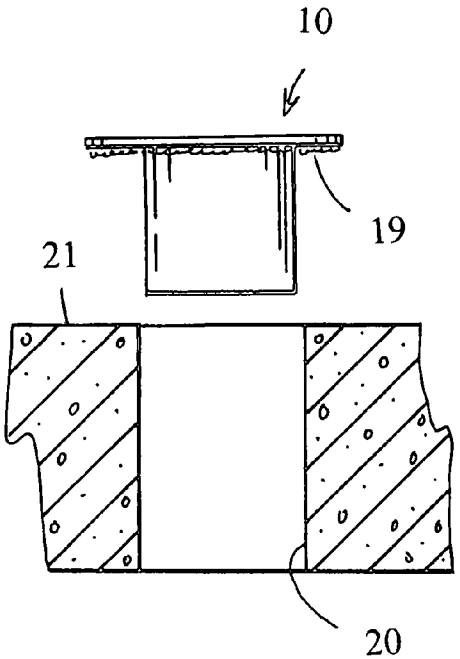
FIGS. 2-4 show a sequence of side views showing a method of repairing a hole in a floor, shown in cross-section, that embodies principles of the invention in a preferred form.
Figure 3:
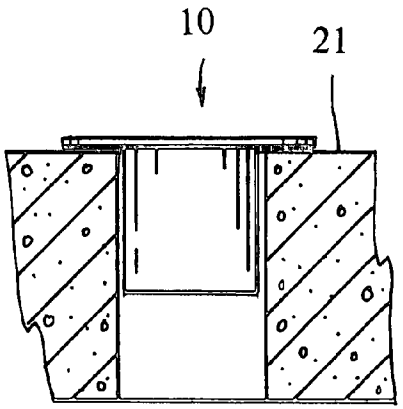
Figure 4:
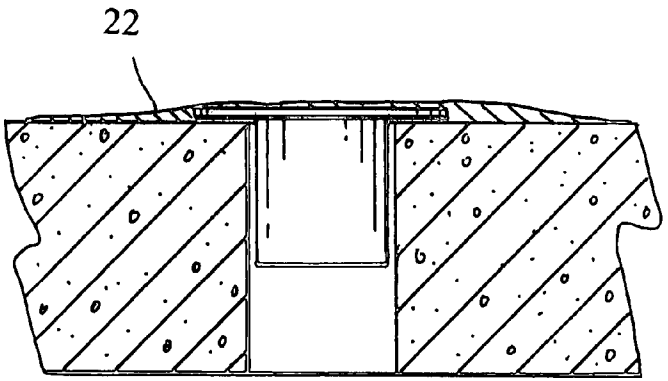

With reference next to FIG. 5, there is shown a floor plug 30 in another preferred form of the invention. Here, the floor plug has a top plate 31 and an externally threaded post 32 depending from the top plate. The floor plug 30 also includes a neck 33 having an internally threaded mounting hole 34 configured to threadably mate with the threaded post 32. Here, an operator may choose from a variety of neck diameters and simply thread the appropriate neck 33 upon the threaded post 32 to form a complete floor plug. The removable neck allows for more flexibility and less overhead associated with the storage of multiple floor plugs.

It should be understood that the top plate 11 may be configured in any form and is not limited to the round shape of the preferred embodiment. It should also be understood that the neck may also be solid and is not limited to a tubular structure.

It thus is seen that a system for repairing a cement floor and a method of repairing a cement floor is now provided. While this invention has been described in detail with particular references to the preferred embodiments thereof, it should be understood that many modifications, additions and deletions, in addition to those expressly recited, may be made thereto without departure from the spirit and scope of the invention as described by the following claims.

The invention claimed is:

1. A method of repairing a hole within a concrete floor, the method comprising the steps of:

(A) providing a plug having a top plate of a size larger than the hole in the concrete floor and a neck of a size smaller than the hole in the concrete floor;

(B) positioning the neck of the plug within the hole of the concrete floor and abutting the top plate against the top surface of the concrete floor surrounding the hole;

(C) overlaying the plug top plate and a portion of the concrete floor surrounding the hole with a viscous leveler;

(D) smoothing the viscous leveler; and (E) allowing the viscous leveler to cure to a hardened state.

2. The method of claim 1 further comprising the step of applying an adhesive between the plug and the concrete floor.

3. The method of claim 2 wherein step (A) the plug top plate is provided with at least one mounting hole, and wherein the method further comprises the step of passing a mounting screw through the top plate mounting hole and into the concrete floor.

4. The method of claim 1 wherein step (A) the plug top plate is provided with at least one mounting hole, and wherein the method further comprises the step of passing a mounting screw through the top plate mounting hole and into the concrete floor.

5. The method of claim 4 further comprising the step of applying an adhesive between the plug and the concrete floor.

6. The method of claim 1 wherein step (A) a plurality of necks of different diameters is provided, and wherein a neck of a select size corresponding to the size of the hole is selected from the plurality of necks.

7. A method of repairing a hole within a concrete floor, the method comprising the steps of:

(A) providing a plug having a top plate and a neck extending from the top plate;

(B) positioning the neck of the plug within the hole of the concrete floor and overlying a portion of the top plate against the top surface of the concrete floor defining the hole;

(C) overlaying the plug top plate and a portion of the concrete floor surrounding the hole with a leveler compound;

(D) allowing the leveler compound to harden.

8. The method of claim 7 further comprising the step of (E) applying an adhesive between the plug and the concrete floor.

9. The method of claim 8 wherein step (A) the plug top plate is provided with at least one mounting hole, and wherein the method further comprises the step of passing a mounting screw through the top plate mounting hole and into the concrete floor.

10. The method of claim 7 wherein step (A) the plug top plate is provided with at least one mounting hole, and wherein the method further comprises the step of passing a mounting screw through the top plate mounting hole and into the concrete floor.

11. The method of claim 10 further comprising the step of (E) applying an adhesive between the plug and the concrete floor.

12. The method of claim 7 wherein step (A) a plurality of necks of different diameters is provided, and wherein a neck of a select size corresponding to the size of the hole is selected from the plurality of necks.

13. A concrete floor repairing system for repairing a hole in concrete comprising:

a plug having a top plate of a size larger than the hole in the concrete and a neck extending from said top plate, said neck having a size smaller than the hole in the concrete; and a concrete leveling compound adapted to overlay said plug and a portion of the concrete floor in a viscous form and then be cured to a hardened state, whereby the plug is placed so that the neck is positioned within the concrete hole and a portion of the top plate overlying the surrounding concrete, and the concrete leveling compound covers the plug to provide a generally even or smooth surface.

14. The concrete floor repairing system of claim 13 further comprising an adhesive bonded to said plug top plate.

15. The concrete floor repairing system of claim 14 further comprising a mounting screw extending through said top plate and into the underlying concrete.

16. The concrete floor repairing system of claim 13 further comprising a mounting screw extending through said top plate and into the underlying concrete.

17. The concrete floor repairing system of claim 16 further comprising an adhesive bonded to said plug top plate.

18. The concrete floor repairing system of claim 13 wherein said neck is removably coupled to said top plate.

19. The concrete floor repairing system of claim 18 wherein said neck is removably coupled to said top plate through corresponding threads extending from said neck and said top plate.

20. The concrete floor repairing system of claim 19 wherein said top plate includes a threaded post and wherein said neck includes a threaded hole configured to threadably receive said threaded post.

21. The concrete floor repairing system of claim 18 wherein said system includes a plurality of necks of various neck diameters.

* * * * *